United States Patent [19]

Häfele et al.

[11] Patent Number: 4,706,626

[45] Date of Patent: Nov. 17, 1987

[54] FUEL INJECTION PUMP FOR INTERNAL COMBUSTION ENGINES

[75] Inventors: Walter Häfele, Fellbach; Josef Güntert, Gerlingen, both of Fed. Rep. of Germany

[73] Assignee: Robert Bosch GmbH, Stuttgart, Fed. Rep. of Germany

[21] Appl. No.: 768,775

[22] Filed: Aug. 23, 1985

[30] Foreign Application Priority Data

Oct. 1, 1984 [DE] Fed. Rep. of Germany ..... 3435987

[51] Int. Cl.[4] ..... F02D 1/02

[52] U.S. Cl. ..... 123/364; 123/503; 123/198 F; 417/428

[58] Field of Search ..... 123/503, 501, 198 F, 123/198 DB, 365, 364; 417/426, 428, 286, 288

[56] References Cited

U.S. PATENT DOCUMENTS

| | | | |
|---|---|---|---|
| 1,967,101 | 7/1934 | Rassbach et al. | 123/198 F |
| 3,385,221 | 5/1968 | Parks | 103/41 |
| 3,712,763 | 1/1973 | Parks | 417/499 |
| 4,071,010 | 1/1978 | Miller | 123/198 F |
| 4,297,979 | 11/1981 | Kamleitner | 123/372 |

*Primary Examiner*—Andrew M. Dolinar
*Attorney, Agent, or Firm*—Edwin E. Greigg

[57] ABSTRACT

A fuel injection pump for internal combustion engines having in-line pumping elements, having pump pistons on which control slides are axially displaceable, in particular for adjusting the injection onset; in a relatively greatly displaced position, these control slides being arranged to interrupt the injection. The control slides are moved by first and second governor rods, each part of which carries one group of driver members of the control slides, and both governor rods are rotatable relative to one another. As a result, it is possible for normal operation to be controlled by the one governor rod, while at the same time an appropriate number of engine cylinders is shut off by the other governor rod, in that the associated control slides are displaced into respective corresponding positions.

14 Claims, 5 Drawing Figures

Fig. 1
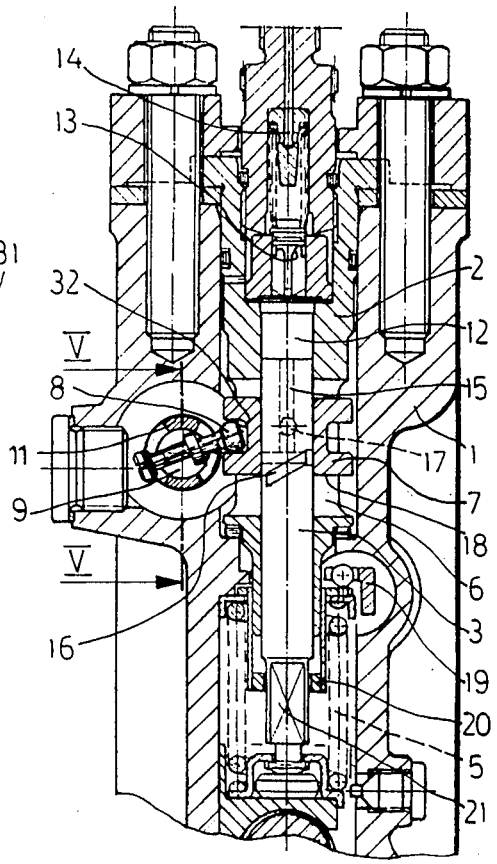
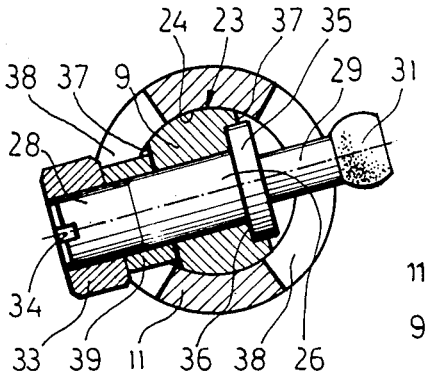
Fig. 3
Fig. 2
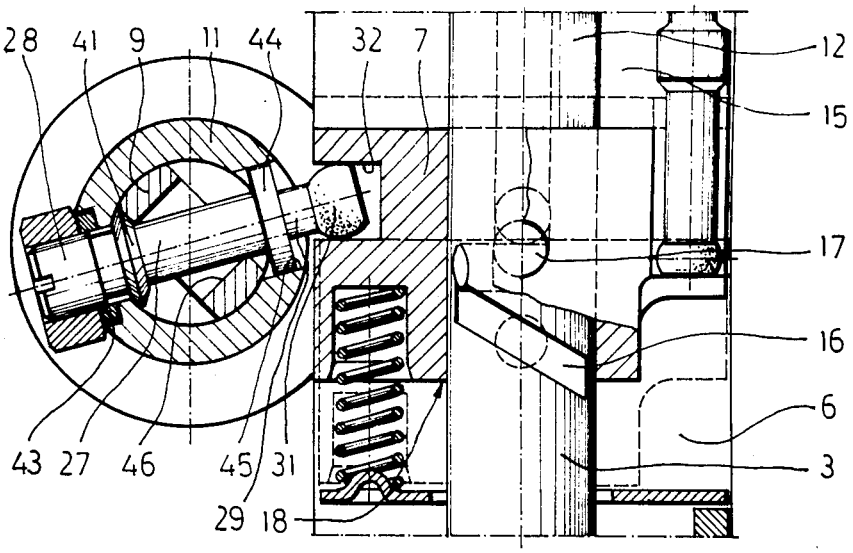

FUEL INJECTION PUMP FOR INTERNAL COMBUSTION ENGINES

BACKGROUND OF THE INVENTION

The invention is based on a fuel injection pump as generically defined hereinafter. In a known fuel injection pump of this kind U.S. Pat. No. 8,712,763, the driver members are embodied as clamping rings, which are adjustably fixed on the round governor rod by clamping the free arms together using a screw, and which have a tang that engages the control slide in an annular groove provided for that purpose. As a result, although the individual driver members can be adjusted relative to one another with respect to their rotational position and hence the control slides can be adjusted relative to one another with respect to their stroke position, they cannot be actuated independently of one another. Thus it is likewise impossible for a partial shutoff of the engine cylinders during idling, which is particularly desirable in large engines, to be attained as in another known fuel injection pump (German Pat. No. 28 21 161), by shutting off the pumping of fuel from one portion of the pump work chambers to the engine. These provisions primarily make it possible to improve the fuel consumption and exhaust and noise emissions during engine idling and partial-load operation. Also, less fuel gets into the motor oil to cause excessive thinning of the oil. Further, a cylinder shutoff is also used in motor vehicles whenever only accessory equipment needs to be driven by the vehicle engine, such as when loading or unloading silo or tank trucks. In contrast to these known in-line injection pumps, in which the pump pistons of individual pump units are rotatable in order to shut pumping down to zero pumping, this provision has not been known in slide-controlled pumps up to now, because a rotation of the slide causes a change in the fuel quantity only if a corresponding oblique-edge control is provided between the relief bore and the control slide.

OBJECT AND SUMMARY OF THE INVENTION

The fuel injection pump according to the invention has the advantage over the prior art that at relatively low expense, this so-called cylinder shutoff is attained, by making a portion of the control slide displaceable into a position in which no injection pressure can build up in the pump work chamber; instead, the injection pressure flows out, relieved of fuel pressure, via the relief bore.

According to an advantageous embodiment of the invention, the two governor rods are arranged coaxially with one another; one governor rod is tubular and guides the other and has radial openings, with play in the rotational direction, for the driver members carried by the other governor rod. Since the openings need merely be large enough that the relative adjustment of the two governor rods is possible, the strength of the rods is not impaired, so that even relatively large adjusting forces can be transmitted without twisting the rods. Not least, considerable installation space is saved by such an arrangement, which is an increasingly important consideration in modern engine design and construction.

According to another embodiment of the invention, the two governor rods are pierced, transversely to the longitudinal axis of the governor rods, by a driver pin having play relative to one or the other governor rod in the rotational direction; this play is dimensioned such that a rotation of the one governor rod in the direction of a constant opening of the relief bores (=engine shutoff) also rotates the other governor rod, and the group of driver members it carriers, into this opening position as well. By means of a driver pin of this kind, which penetrates both governor rods, an additional means of axial fixation of the two governor rods with respect to one another can advantageously be dispensed with, and relatively fine tolerances can be attained, because no additional securing means, for instance for securing the driver pin to the governor rod, are required.

An embodiment of the invention which is particularly favorable in terms of its manufacture and assembly provides that the driver members are embodied as rotating parts having a threaded section and secured to the associated governor rod. Eccentrically offset tangs can be disposed on one end of the driver members for engagement with the control slide, and the driver members can be secured against self-twisting by means of nuts extending along the threaded section. It is therefore possible to manufacture the governor rods and driver members by simple metal-cutting operations. Furthermore, the adjustment can be performed by an automatic adjusting machine, because of the arrangement and accessibility of such driver members.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a longitudinal cross section taken through the upper part of an in-line fuel injection pump;

FIG. 2 is a detail of FIG. 1, on an enlarged scale, showing the control slide in various positions and in a section taken along the line II—II of FIG. 4;

FIG. 3 is a section taken through the governor rod along the line III—III of FIG. 4;

DESCRIPTION OF THE PREFERRED EMBODIMENT

Figure 4:
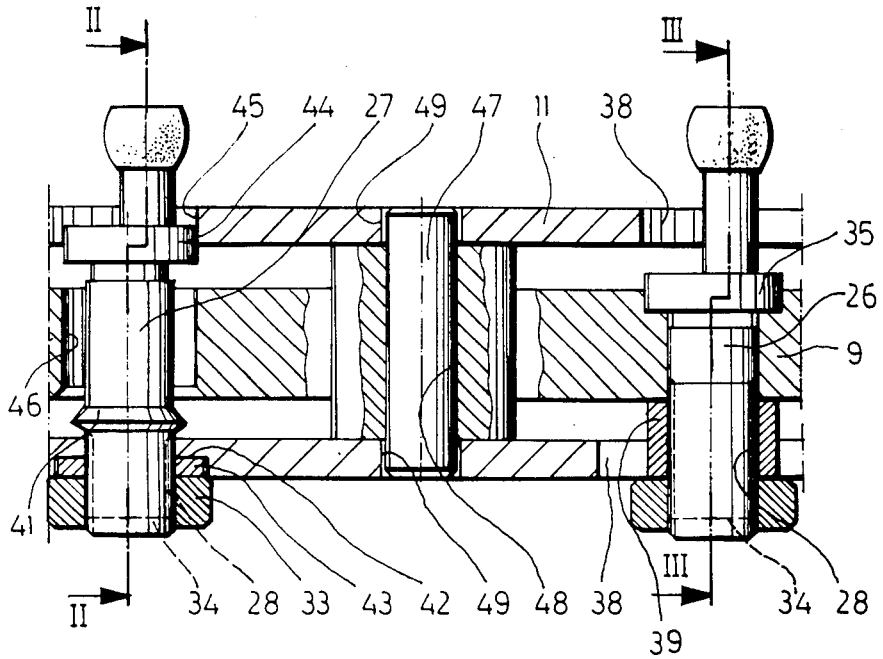
FIG. 4 shows a fragmentary section of the axially aligned driver members.
Figure 5:
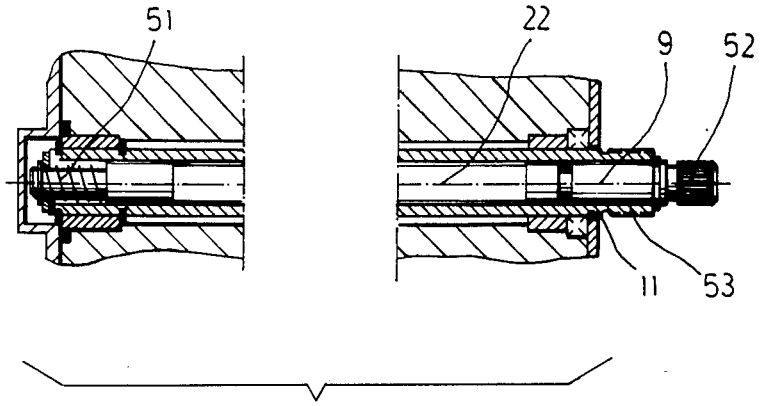
FIG. 5 is a fragmentary section taken along line V—V of FIG. 1.

A plurality of cylinder liners 2, only one of which is shown, is positioned in a line into a housing 1 of an in-line fuel injection pump. In these liners 2, pump pistons 3 are driven via a camshaft, counter to the force of a spring 5, for their axial movement that embodies the working stroke. Each of the liners 2 include a recess 6 which receives a control slide 7 that is axially displaceable on the pump piston 3. Each of the control slides 7 are actuated via a driver member 8, which is connected to either a first governor rod 9 or a second governor rod 11, the second rod 11 being disposed in tubular fashion around the first rod 9, so that a rotational movement of one of the governor rods causes a corresponding displacement of the associated control slides 7. A pump work chamber 12 is defined by the pump piston 3 and the cylinder liner 2; from this pump work chamber, the pump piston can pump fuel during its compression stroke to the internal combustion engine via a pressure valve 13 and a pressure line 14. A relief bore 15 extending within the pump piston 3 also branches off from this pump work chamber 12 and communicates with an oblique groove 16 disposed on the jacket face of the piston. A control bore 17 is also provided in the control slide 7. In order to control the relief bore 15, the oblique groove 16 cooperates with the control edge 18, embodied by the lower edge of the control slide, on the one hand and on the other hand with the control bore 17, in such a manner that as long as the oblique groove is at least partially uncovered by the control bore 17 or the lower control edge 18, fuel can flow out of the pump work chamber 12 without pressure via the relief bore 15.

Depending on the rotational position of the pump piston 3, the oblique groove 16 is arranged to coincide with the control bore 17 earlier or later, thereby determining the injection quantity. To this end, in a known manner, the pump piston 3 is rotated by means of a governor rod 19 of a speed governor, and for this purpose the governor rod 19 engages a correspondingly flattened portion 21 of the piston via a sleeve 20.

As shown in FIGS. 2–5, the first governor rod 9 is embodied solidly, and in the area 22 facing the control slides 7 it is flattened in such a way that the remaining cylinder segments 23 on the inner wall 24 of the tubularly embodied second governor rod 11 are guided for a relative rotational movement of the governor rods with respect to one another.

A first group of first driver members 26 (FIGS. 3 and 4) is secured to the first governor rod 9, and a second group of second driver members 27 (FIGS. 2 and 4) is mounted on the second governor rod 11. The first and second driver members 26, 27 are embodied in the manner of bolts and each has a threaded section 28 on one end and a tang 29, which is offset eccentrically with respect to the longitudinal axis, and head 31 on the other end. The head 31 engages an annular groove 32 disposed on the control slide 7. A nut 33 screws onto the threaded section 28 in order to firmly clamp the driver member onto the governor rod. Furthermore, a slit or kerf 34 for access with a rotating tool such as a screwdriver is provided on the end of the driver member 26 remote from the head 31, so that with the eccentric arrangement of the tangs 29, the individual heads 31 and the control slides 7 are adjustable relative to one another by rotating the driver members 26. The adjusted position can be fixed by tightening the nuts 33.

The first driver member 26 has a collar 35, as the counterpart bearing to the nut 33, and the collar is supported on a machined face 36, which is located on one of the two flattened sides 37 of the first governor rod 9.

Radial openings 38 for the first driver members 26 are provided in the second governor rod 11, in order to enable them to pivot with respect to the second driver members 27 or to enable a relative rotation of the first governor rod 9 with respect to the second governor rod 11. Between the nut 33 and the governor rod 9, a sheath 39 for transmitting force is provided, as a result of which on the one hand the opening 38 on this side is embodied only just as large as absolutely necessary, and on the other hand the nut 33 can be engaged by a wrench-type tool outside the second governor rod 11.

The second driver member 27 has a conical collar 41 at the end of the threaded section 28; in order to firmly clamp the driver member 27, this collar 41 rests on the inside of the tubular governor rod 11. In the outer jacket face of this second governor rod 11 is a machined recess 42 for receiving a shim 43, by way of which the force is transmitted from the nut 33 onto the governor rod. On the side of this second governor member 27 remote from the threaded section 28, there is a collar 44, which is guided in a bore 45 of the second governor rod 11. In order to enable the relative movement of the first and second driver members 26, 27 with respect to one another, or the relative rotation of the governor rods 9 and 11 with respect to one another, appropriate recesses 46 are provided in the first governor rod 9 for the passage therethrough of the second driver members 27.

Because of this relative rotation of the two governor rods with respect to one another, a portion of the control slides 7 can be axially displaced with respect to the other portion, whereby a portion of the in-line pumping units of the fuel injection pump can be shut off in terms of injection, without affecting the injection function of the other portion; this will be described in greater detail below. In this exemplary embodiment, the first governor rod 9 having the first driver members 26 is rotatable for the purpose of "cylinder shutoff" contrary to the second governor rod 11 having the second driver members 27.

Serving as a driver coupling between the two governor rods 9 and 11 is a pin 47, as shown in FIG. 4, which is guided in a transverse bore 48 of the first governor rod 9 and with its ends slides in circumferential grooves 49 of the second governor rod 11. These circumferential grooves 49 enable a corresponding rotation of the first governor rod 9 in order to displace the associated control slides 7 into a position for cylinder shutoff; however, if the second governor rod 11 is rotated into such a position and the first governor rod 9 was in its normal operating position, the effect of these grooves 49 would be that the first governor rod 9 would be rotated along with the second rod 11 for the cylinder shutoff.

By means of a rotary spring 51 (FIG. 5) which with one end engages the first governor rod 9 and with the other end engages the second governor rod 11, the first governor rod 9, during normal operation, is kept in a position with respect to the second governor rod 11 in which all the driver members 26, 27, or all the control slides 7, assume the same working position. By engaging a knurled head 52 of the first governor rod, this rod 9 can then be rotated relative to the second governor rod 11 into the shutoff position, counter to the force of the spring 51, in the above manner. For adjusting as well as maintaining the position of the second governor rod 11, gear teeth 53 provided adjacent to its end are used, which are engaged by appropriate adjusting means such a ring gears or levers; the same applies to the knurled head 52.

OPERATION

The operation of the fuel injection pump according to the invention will now be explained in further detail, referring to FIG. 2:

The second governor rod 11 along with the second driver member 27 has just assumed a position for normal operation. The same applies to the right half of the control slide 7 illustrated, which with its lower control edge 18 uncovers the lower end of the oblique groove 16 to such an extent that there is communication between the pump work chamber 12 and the recess 6. Now as soon as the pump piston begins its compression stroke, this lower section of the oblique control edge 16 protrudes into the control slide 7, so that subsequently the pressure required for the injection can build up in the pump work chamber 12. Then as soon during the ensuing continued compression stroke as the control edge 16 comes to coincide with the control bore 17 disposed in the control slide 7, the injection is interrupted, because the fuel can now, substantially relieved of pressure, flow out of the pump work chamber 12 via the relief bore 15 and the control bore 17. In this exemplary embodiment, the rotation of the two governor rods serves primarily to adjust the injection onset. It the control slide 7 is displaced upward into the position shown in dashed lines (right half of the control slide), then the control bore 17 correspondingly attains a higher position. Since the oblique groove 16 disposed on the pump piston 3 does not follow this movement, the prestroke of the pump piston 3, before the control edge 16 protrudes into the control slide 7, is correspondingly longer, and the injection onset is shifted to later, corresponding to the rotational position of the camshaft of the injection pump.

If the first governor rod 9 as shown in FIG. 2 is rotated counterclockwise, the correspondingly disposed portion of the control slides 7 is displaced into the position shown in dot-dash lines. As shown, in this position the control edge 16 coincides with the control bore 17, and after the beginning of the upward stroke of the pump piston 3, the control edge 16 moves back out of the control slide 7 before being separated from the control bore 17, so that communication always exists between the pump work chamber 12 and the recess 6. Accordingly, injection pressure cannot build up, and injection cannot take place. This cylinder shutoff is also performed on the basis of normal operation of all the control slides 7, whenever the second governor rod 11 is rotated counterclockwise and via the pin 47 carries along the first governor rod 9 and its group of articulated control slides, so that all the control slides 7 are moved into a position for cylinder shutoff and hence shutoff of the engine.

Naturally it is also conceivable for the invention to be applied to controlling injection quantity; then the control slide controls the injection quantity by its rotation or axial displacement, and at least some of the control slides are displaceable into the cylinder shutoff position.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising a plurality of reciprocating in-line pump pistons, each of said pump pistons having at least one relief bore and guided in separate pump cylinders, pump work chambers in each of said cylinders, axially movable control slides for controlling said at least one relief bore in each of said pistons, first and second rotatable interrelated governor rods, driver members disposed on said first and second rotatable governor rods adapted to actuate said control slides relative to said pistons, said driver members comprising a first and second group of driver members, said first governor rod arranged to carry and move said first group of said driver members which arbitrarily moves said control slide into a position when said at least one relief bore of one of said pistons is constantly open, and said second governor rod is arranged to carry and move said second group of driver members that simultaneously controls normal operation;

and said first and second governor rods are rotatably positioned one within the other, said second governor rod being a tubular body with an inner wall and provided with radially extending openings to receive said driver members of said first governor rod.

2. A fuel injection pump as defined by claim 1, further wherein said driver members carried by said first governor rod cross through recesses in said tubular governor rod whereby a pre-determined degree of play in a rotary direction is available.

3. A fuel injection pump as defined by claim 2, further wherein said play in said rotary direction of increasing injection quantity is dimensioned such that upon rotation of said second governor rod in the direction of constant opening of said at least one relief bore (engine shutoff), said first group of driver members of said first rotatable governor rod, as well as said first rotatable governor rod, are rotated with said second governor rod into an open position.

4. A fuel injection pump as defined by claim 3, further wherein said first governor rod further includes flattened areas each of which areas terminate in arcuate walls which engage said inner wall of said second governor rod and is guided with cylinder segments, provided on the narrow sides, on the inner wall of said tubular governor rod.

5. A fuel injection pump as defined by claim 2, further wherein said first and second governor rods further include a longitudinal axis, said axis being penetrated by a driver pin, said driver pin having play in the rotational direction with respect to said first and second governor rods and said play in said first and second governor rods being dimensioned such that upon a rotation of one of said first and second governor rods in the direction of constant opening of said at least one relief bore, the other of said first and second governor rods, along with said driver member carried thereby is rotated into an open position.

6. A fuel injection pump as defined by claim 2, further wherein said first governor rod further includes flattened areas each of which areas terminate in arcuate walls which engage said inner wall of said second governor rod and is guided with cylinder segments, provided on the narrow sides, on the inner wall of said tubular governor rod.

7. A fuel injection pump as defined by claim 1, further wherein there is a play in said rotary direction of increasing injection quantity dimensioned such that upon rotation of said second governor rod in the direction of constant opening of said at least one relief bore (engine shutoff), said first group of driver members of said first rotatable governor rod, as well as said first rotatable governor rod, are rotated with said second governor rod into an open position.

8. A fuel injection pump as defined by claim 7, further wherein said first and second governor rods further include a longitudinal axis, said axis being penetrated by a driver pin, said driver pin having play in the rotational direction with respect to said first and second governor rods and said play in said first and second governor rods being dimensioned such that upon a rotation of one of said first and second governor rods in the direction of constant opening of said at least one relief bore, the other of said first and second governor rods, along with said driver member carried thereby is rotated into an open position.

9. A fuel injection pump as defined by claim 7, further wherein said first governor rod further includes flattened areas each of which areas terminate in arcuate walls which engage said inner wall of said second governor rod and is guided with cylinder segments, provided on the narrow sides, on the inner wall of said tubular governor rod.

10. A fuel injection pump as defined by claim 1, further wherein said first and second governor rods further include a longitudinal axis, said axis being penetrated by a driver pin, said driver pin having play in the rotational direction with respect to said first and second governor rods and said play in said first and second governor rods being dimensioned such that upon a rotation of one of said first and second governor rods in the direction of constant opening of said at least one relief bore, the other of said first and second governor rods, along with said driver member carried thereby is rotated into an open position.

11. A fuel injection pump as defined by claim 1, further wherein said first governor rod further includes flattened areas each of which areas terminate in arcuate walls which engage said inner wall of said second governor rod and is guided with cylinder segments, provided on the narrow sides, on the inner wall of said tubular governor rod.

12. A fuel injection pump as defined by claim 1, further wherein, said first and second governor rods are provided with a rotationally elastic member, said elastic member arranged to pre-position said first and second governor rods relative to said driver members, said elastic member being arranged to engage at least one of said first and second governor rods.

13. A fuel injection pump as defined by claim 1, further wherein said driver members are embodied as rotating elements having threaded sections which are secured on respective governor rods.

14. A fuel injection pump as defined by claim 13, further wherein said driver members include tangs for engaging said control slides, said tangs being mounted eccentrically relative to said driver members, and further that said respective driver members are securely fastened to each of said first and second governor rods.

* * * * *